United States Patent [19]

Gunnergaard

[11] 3,999,594

[45] Dec. 28, 1976

[54] APPARATUS FOR PRODUCING CASTING MOULDS CONSISTING OF IDENTICAL MOULD PARTS

[75] Inventor: Marius Gunnergaard, Lyngby, Denmark

[73] Assignee: Dansk Industri Syndikat A/S, Herlev, Denmark

[22] Filed: Aug. 27, 1975

[21] Appl. No.: 608,336

[30] Foreign Application Priority Data

Sept. 5, 1974 Denmark ..... 4697/74

[52] U.S. Cl. ..... 164/187; 164/211

[51] Int. Cl.[2] ..... B22C 15/08; B22D 47/02

[58] Field of Search ..... 164/187, 188, 211, 210, 164/172, 173

[56] References Cited

UNITED STATES PATENTS

| | | | |
|---|---|---|---|
| 3,672,441 | 6/1972 | Wells et al. | 164/351 |
| 3,709,282 | 1/1973 | Taccone | 164/187 |
| 3,802,486 | 4/1974 | Otaki | 164/187 |
| 3,817,314 | 6/1974 | Deve | 164/210 X |

*Primary Examiner*—Travis S. McGehee
*Attorney, Agent, or Firm*—Imirie, Smiley & Linn

[57] ABSTRACT

In an apparatus including a single pressure chamber for successively producing identical mould parts to be stacked closely together on a guideway, at least one carrier frame is provided for the transfer of the mould parts from the pressure chamber to the guideway.

5 Claims, 6 Drawing Figures

APPARATUS FOR PRODUCING CASTING MOULDS CONSISTING OF IDENTICAL MOULD PARTS

BACKGROUND OF THE INVENTION

The invention relates to an apparatus for producing casting moulds of the type consisting of a row of identical mould parts stacked closely together and having at least one pouring cavity at each joint in the mould. The apparatus comprises a device with a pressing chamber for the successive production of the mould parts by the compression of sand or a similar material between a pressure plate and a counter-pressure plate, and at least one guideway on which the mould parts are stacked together and advanced stepwise. During this stepwise advance the casting mould passes a pouring station and subsequently a cooling path of a suitable length and, finally, the castings can at a knocking-out station be separated from the mould sand or the corresponding material.

The most commonly known apparatus of this kind comprises a stationary pressing chamber which is flush with the guideway and in which the pressure plate and the counter-pressure plate constitute movable end walls. Above the pressing chamber, a hopper is mounted, from which sand is shot into the chamber by means of compressed air. The complete cycle or process consists of a total of six successive operations, viz. the shooting of the sand into the chamber, the compression of the mould sand by the pressure plate being moved against the counter-pressure plate, the opening of the chamber by the counter-pressure plate being withdrawn and swung away after the compression pressure has been relieved, the advance of the mould part from the chamber to the guideway by means of the pressure plate, the withdrawal of the pressure plate into its initial position, and the closing of the chamber by return motion of the counter-pressure plate. The fourth and the fifth of these operations are usually the most time-consuming, because it involves relatively long travels of the pressure plate, and because the movement of the said plate, at any rate during the last part of the advance stroke and the commencement of the return stroke, must be performed slowly out of regard to the careful addition of the new mould part to the casting mould already formed and the subsequent careful withdrawal of the pressure plate from this mould part. The consumption of time will be additionally increased if the pressure plate, as it is customary, shall also contribute to the stepwise advance of the casing mould on the guideway after the addition of each mould part.

It has been attempted to increase the capacity of casting plants of the kind mentioned above, expressed in number of mould parts per unit of time, by providing two or more pressing chambers in connection with a single set of pressure and counter-pressure plates and one or two guideways.

By way of example, the specification of British Patent No. 803,332 discloses an apparatus comprising two frames incorporated in a slide which is displaceable transversely to the pressing direction, and two guideways parallel to the pressing direction. In one extreme position of the slide, a first frame is in the pressing position in relation to the pressure and counter-pressure plates, while the second frame is in the delivery position in relation to one of the guideways, and in the other extreme position of the slide the first frame is in the delivery position in relation to the other guideway, while the second frame is in the pressing position.

Another example is known from the specification of Danish Patent No. 127,044 which discloses an apparatus comprising a plurality of frames which are arranged in a circular series on a table that can be rotated by steps. During the movement of the said table each frame passes successively a pressing position between a set of pressure and counter-pressure plates, one or more core insertion positions and an ejection position in which the mould parts with the cores placed in them are ejected onto a guideway for the successive formation of the casting mould.

Common to these two prior art structures is that the pressing of the mould parts occurs alternately in two or more frames which in addition serve for conveying the mould parts to the guideway or pouring track or tracks. In this way an increase in production capacity may be achieved but there is also an increased risk of differences in shape between the successively produced mould parts, since there may be differences in tolerance between the frames, or differences may occur due to varying wear during the operation of the apparatus. Another element of risk is that the frame are not fixed with the necessary precision in the pressing position, which may also load to inaccuracies in the castings produced.

SUMMARY OF THE INVENTION

The apparatus according to the invention differs from the prior art embodiments in that the addition to the pressing chamber, it comprises at least one carrier frame which is movable between a mould part receiving position in connection with the pressing chamber and a delivery position at the guideway or at least one of the guideways.

In this case, the total number of mould parts are consequently produced in one and the same pressing chamber which may even be stationary so that both of the above-mentioned sources of lack of accuracy of shape are avoided. Since the carrier frame or the frames serve solely for conveying the mould parts they have no influence on the shaping of these parts, the shape being determined definitely by the compression in the pressing chamber, and consequently there are no strict requirements with regard to the shape and guiding of the frames.

In comparison with the apparatus mentioned above and comprising a single pressing chamber from which the mould part is pushed out onto the guideway by means of the pressure plate, the invention offers the advantage that the maximum stroke of the pressure plate can be reduced essentially and that the re-closing of the pressing chamber can therefore be performed at a relatively early point, viz. already while the mould part just produced is being transferred to the guideway by means of the carrier frame. This entails not only that the cycle period for the mould part producing apparatus can be reduced, but in addition that the driving mechanism for the pressure plate can be simplified. Inter alia, this driving mechanism is no longer responsible for the careful addition of the mould part to the casting mould previously formed, and it shall not, either, contribute to the advance of the casting mould on the guideway. The first and if occasion should arise, also the second of these functions have been taken over by the carrier frame which may relatively easily be made capable of solving this problem or these problems.

DESCRIPTION OF THE PREFERRED EMBODIMENTS

Figure 1:
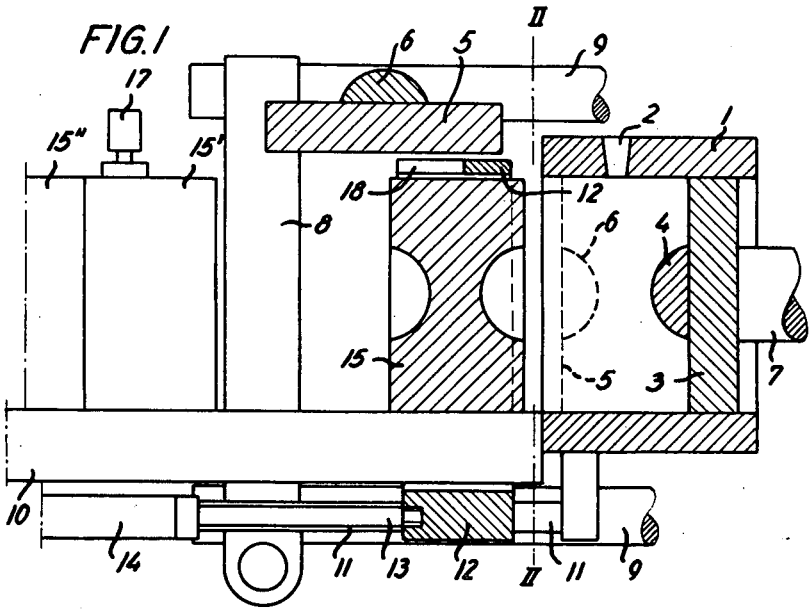
FIG. 1 is a diagrammatical side elevational view, partly in section, of a first embodiment of the apparatus according to the present invention comprising a single reciprocating conveyor frame.
Figure 2:
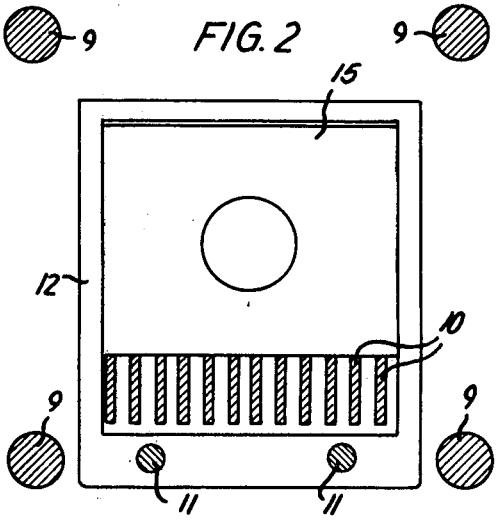
FIG. 2 is a cross-section view taken along line II—II in FIG. 1 and with certain parts omitted.

The apparatus shown in FIG. 1 comprises a stationary pressing chamber 1 which is open at the ends and which in its top wall is provided with a so-called shot slot 2 which is in communication with a hopper, not shown, with mould sand. The pressing chamber 1 comprises a pressure plate 3 with a semi-pattern 4 and a counter-pressure plate 5 which likewise carries a semi-pattern 6. The pressure plate 3 functions as a ram in the chamber 1 and is connected to a driving mechanism via a rod 7. This plate is shown in its position at the termination of the compression stroke which serves for compressing the mould sand against the counter-pressure plate 5 which in this situation is in the position indicated in dotted lines and consequently closes the left-hand end of the chamber. The counter-pressure plate 5 is mounted swingably on a cross-member 8 which is carried by four horizontal guide columns 9, see also FIG. 2, so that, after the pressure of the pressure plate 3 has been relieved, the counter-pressure plate 5 can first be displaced away from the pressing chamber 1 and can next be swung up into the position shown in full lines, thereby opening the chamber towards a guideway 10 which is located in continuation of the chamber and in the embodiment shown is constituted by a grate, see FIG. 2.

Figure 3:
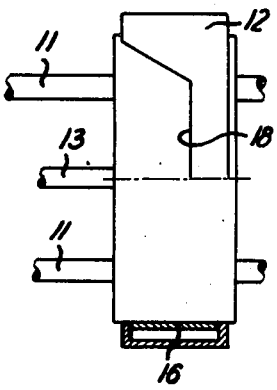
FIG. 3 is a plan view, partly in section, of the carrier frame with a mould part fitted in it.

On a pair of horizontal guide columns 11 under the guideway 10 a carrier frame 12 is accommodated which via a rod 13 is connected to the ram of a hydraulic or pneumatic cylinder 14. After the counter-pressure plate 5 has been displaced and swung up, the frame 12 is displaced towards the open end of the chamber 1, and the mould part 15 formed in this chamber is by means of the pressure plate 3 displaced out of the chamber into the position in FIG. 1 where the mould part stands on the guideway 10 and is enclosed by the frame 12. Next, the mould part is securely clamped in the frame, and this may for example be performed by means of one or more movable wall sections 16, FIG. 3, which can be actuated in an optional manner, expediently pneumatically, between a free position and a clamping position. After the pressure plate 3 has been withdrawn from the mould part 15, the latter is by a displacement of the frame 12 advanced on the guideway 10 to be added to the casting mould which has already been formed and consists of the mould parts 15′, 15″ previously produced. At the same time the whole mould is advanced one step on the guideway, so that the mould part 15 will take up the position in which the mould part 15′ is shown. In this position the mould part can be retained temporarily by means of a pneumatic lock 17 operating in a recess 18 in the top side of the frame 12, after which the clamping of the mould part in the frame can be released.

As soon as the mould part 15 has been taken over by the frame 12 in the position shown, the pressure plate 3 can return to its starting position, and, already before the said displacement of the casting mould has been terminated, the chamber 1 can be reclosed by the counter-pressure plate 5 being swung down and displaced back, so that the chamber is quickly ready for producing the next mould part. The insertion of cores, if any, may be performed in a well-known manner in the pouring cavity of the mould part added last.

Figure 4:
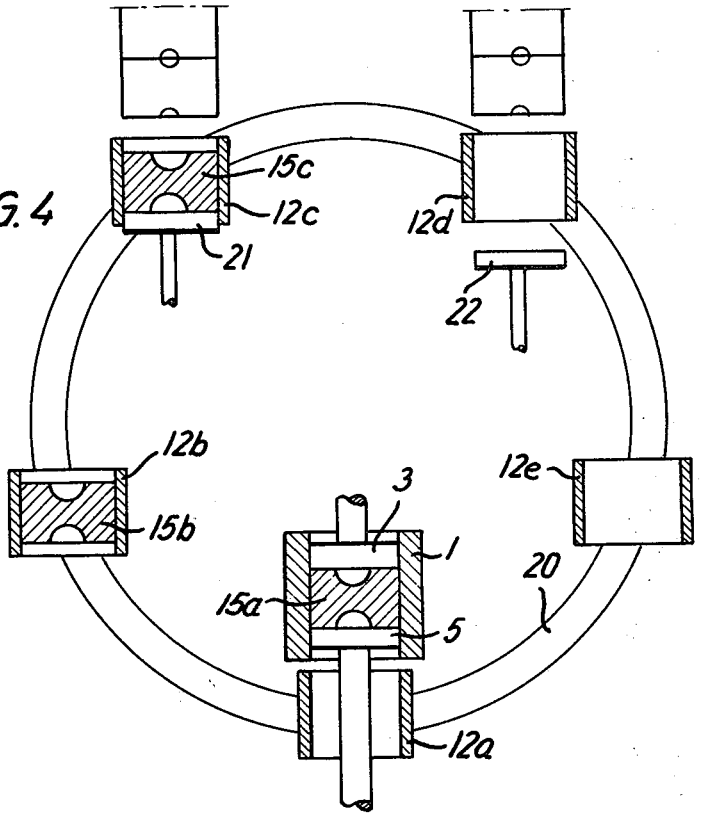
FIG. 4 is a diagrammatical plan view of another embodiment of the apparatus according to the invention and FIGS. 5 and 6 show parts of still another embodiment of the apparatus, shown in side elevation and partly in axial section and in two different operational steps.

If more time is desired for the insertion of cores and for the pouring, the apparatus may comprise several carrier frames which are movable in unison between a common receiving position and a common delivery position or individual delivery positions. An example is shown in FIG. 4 in which the apparatus comprises a stationary pressing chamber 1 with a pressure plate 3 and a counter-pressure plate 5 in the same way as explained above apart from the fact that in this case the counter-pressure plate 5 is simply displaceable between its active position, as shown in the drawing, and its inactive or open position. The pressing chamber 1 is placed on the radially inner side of a ring 20 which can be rotated by steps around a vertical axis and comprises five equidistant carrier frames 12*a* to 12*e* which are successively brought into a common receiving position in line with the pressing chamber 1. After a mould part 15*a* has been finished, it is by means of the pressure plate 3 transferred to the carrier frame 12*a* during or after withdrawal of the counter-pressure plate 5 through this frame. At the same time, a previously produced mould part 15*c* can be pushed out of its carrier frame 12*c* by means of a ram 21 intended for this operation. When this ram and the pressure plate 3 have been brought clear of the associated frames 12*c* and 12*a*, the ring 20 can be turned one step forwards, whereupon a next mould part is produced in the chamber 1 and is transferred to the frame 12*e*. In this phase, the ejector ram 21 can remain inactive, so that the mould part 15*b* stays in its frame 12*b* and by the next turning step is brought into position in line with another ejector ram 22, while at the same time the frame 12*a* has taken up its position in line with the ejector ram 21. The two mould parts 15*b* and 15*a* can then simultaneously be added separately to one of the two casting moulds, part of which is shown at the top of the figure. As appears from this figure, the carrier frames 12*a* to 12*e* should be guided in such a way in relation to the rotatable ring 20 that their movement becomes translatory. Thus, the mould parts maintain their original axial orientation and, accordingly, the guideways for the two casting moulds can be parallel so as to require less space and become easier to operate than if they were oriented radially outwards from the axis of the rotatable ring.

The insertion of cores may in this case be performed in the intermediate position in which the frame 12*b* is shown in the drawing.

A similar apparatus comprising a rotatable ring and several carrier frames may also be used in combination with a single guideway so that all the mould parts are incorporated in the same casting mould.

Figure 5:
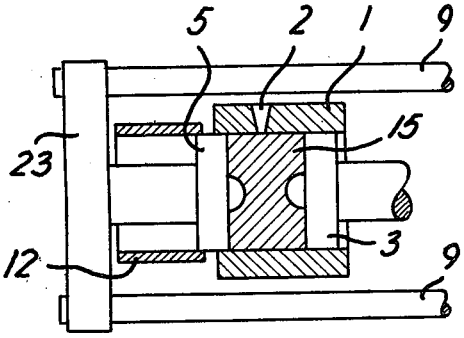
Figure 6:
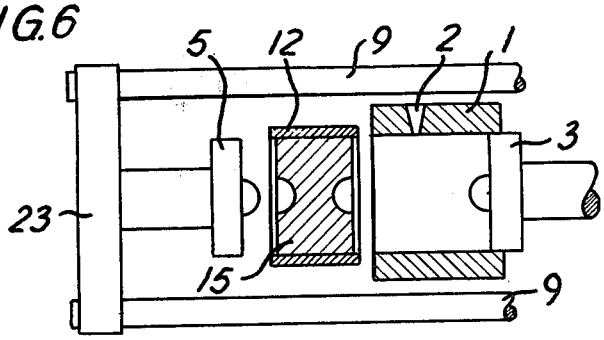

FIGS. 5 and 6 show another embodiment incorporating several carrier frames 12, although only a single one of these frames is shown in the drawing. The pressing chamber 1 with the pressure plate 3 may be arranged as shown in FIG. 1, but the counter-pressure plate 5 is carried rigidly by a displaceable yoke 23. In the pressing position, FIG. 5, the counter-pressure plate has been pushed forwards through the frame 12 and closes the left-hand end of the chamber 1. After the pressing operation, the plate 5 is withdrawn to the position in FIG. 6, and the pressure plate 3 is utilized for transferring the mould part 15 to the frame 12 and next returns to its starting position. The frame with the mould part is then moved in one step or several steps into a delivery position in line with a guideway, not shown, and at the same time another frame is brought into position between the counter-pressure plate 5 and the chamber 1, whereupon the latter is closed by the counter-pressure plate being pushed forwards into the position in FIG. 5. The movement of the frame occurs in this case transversely to the pressing direction and may be a vertical or horizontal movement of displacement or a circular movement around an axis parallel to the pressing direction or possibly a combination of such movements. Also in the case of this arrangement the apparatus may have two or even more guideways.

What is claimed is:

1. An apparatus for producing casting moulds consisting of a row of identical mould parts stacked closely together and having at least one pouring cavity at each joint in the mould, comprising pressing chamber means for the successive production of the mould parts by the compression of mould material between a pressure plate and a counter-pressure plate, at least one guideway on which the mould parts are stacked together and advanced stepwise, and at least one carrier frame movable between a mould part receiving position adjacent said pressing chamber means and a delivery position at an entry end of said guideway for transporting said mould parts from said pressing chamber means to said guideway.

2. An apparatus as claimed in claim 1 comprising a single guideway disposed axially in line with said pressing chamber means, and wherein said counter-pressure plate in the compression position closes an end of said pressing chamber means facing the guideway and is movable to an inactive position in which it enables the formed mould part to be ejected toward said guideway, and wherein a single carrier frame is axially movable towards and away from the said end of said pressing chamber means and has means for the releasable fixation of the mould part during transport thereof away from said pressing chamber means.

3. An apparatus as claimed in claim 1, wherein two or more carrier frames are provided that are movable in unison between a common receiving position adjacent said pressing chamber means and a delivery position.

4. An apparatus as claimed in claim 3, wherein the carrier frames are supported by a rotatable ring that is rotatable by steps around a vertical axis and during this movement passes the common receiving position and at least two delivery positions, each associated with one guideway.

5. An apparatus as claimed in claim 4, wherein the carrier frames are guided in relation to the rotatable ring for translatory movement thereon.

* * * * *